United States Patent [19]

Hori et al.

[11] 4,293,599

[45] Oct. 6, 1981

[54] METHOD OF FORMING DECORATIVE RELIEF PATTERN AND PATTERN-FORMING DEVICE THEREFOR

[75] Inventors: Kiyoshi Hori, Osaka; Nobuyoshi Nagata, Nara, both of Japan

[73] Assignee: Nippon Paint Co., Ltd., Osaka, Japan

[21] Appl. No.: 626,446

[22] Filed: Oct. 28, 1975

[30] Foreign Application Priority Data

Oct. 29, 1974 [JP] Japan ..... 49-125247
Nov. 5, 1974 [JP] Japan ..... 49-127764

[51] Int. Cl.[3] ..... B05D 3/12; B05D 5/02

[52] U.S. Cl. ..... 427/274; 427/278; 427/280; 427/287; 427/359; 427/428; 264/293; 118/DIG. 15; 428/172

[58] Field of Search ..... 428/156, 172, 158, 160, 428/195; 427/271, 270, 278, 274, 359, 361, 365, 369, 371, 260, 262, 264, 280, 267, 428, 287, 424, 256, 265; 29/131, 132; 118/DIG. 15, 264, 212; 264/293

[56] References Cited

U.S. PATENT DOCUMENTS

| | | | |
|---|---|---|---|
| 1,436,155 | 11/1922 | Domy | 101/376 |
| 1,741,698 | 12/1929 | Hampson | 427/278 |
| 2,637,272 | 5/1953 | Hesson | 118/DIG. 15 |
| 2,708,763 | 5/1955 | Jacoby | 29/131 |
| 2,840,487 | 6/1958 | Messina | 427/278 |
| 3,769,058 | 10/1973 | Bayer et al. | 427/278 |
| 3,853,577 | 12/1974 | Nishida et al. | 427/278 |
| 3,936,541 | 2/1976 | Plownan et al. | 428/195 |
| 3,950,833 | 4/1976 | Adams | 29/132 |
| 3,955,260 | 5/1976 | Sherden | 118/DIG. 15 |
| 4,105,816 | 8/1978 | Hori | 428/159 |

*Primary Examiner*—Stanley S. Silverman
*Attorney, Agent, or Firm*—Wenderoth, Lind & Ponack

[57] ABSTRACT

A decorative relief finish pattern is formed by applying to the surface of a coated article or substrate a pattern-forming device composed of a rigid or semi-rigid porous, air-permeable material and having a design thereon. The pattern-forming device, when applied on the surface of the article or substrate a plurality of times, can form such a decorative relief pattern without any undesirable and noticeable protuberance and joints between the first rundown and the subsequent ones.

19 Claims, 16 Drawing Figures

METHOD OF FORMING DECORATIVE RELIEF PATTERN AND PATTERN-FORMING DEVICE THEREFOR

Figure 1A:
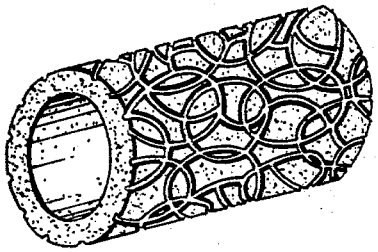

The present invention relates to a method of forming a decorative relief finish pattern on the surface of a coated article or substrate with a pattern-forming device and the device therefor. More particularly, it relates to a decorative relief finish process on the coated article or substrate surface with a pattern-forming device which is made of a rigid or simi-rigid, porous, air-permeable material.

Heretofore, a decorative relief pattern has been formed on the surface of a coated substrate such as a wall substrate and the like with a pattern-forming device such as a deisgn roller with the design which projects the surrounding roll surface. It is made of a material having neither porous structure nor a property to permeate air therethrough, such as a rubbery or wooden material. And such a material cannot absorb a releasing liquid such as water therein. Accordingly, the design rollers of this type have been applied while said releasing liquid is intermittantly or continuously fed to the surface of the rollers by a conventional feeder such as feed roller or a sponge feeder. Such design rollers, however, tend to let certain amounts of a coating present on the coated substrate surface stick to their surface and consequently come off from the coated surface as they are rolled. And they also may give rise to the formation of undesirable and noticeable protuberances from the surrounding coated surface along the patterned areas as the projections of the rollers constituting the design leave from the patterened surface. These tendencies may increase as a period of application is rendered longer. Such deformations of a pattern on the coated surface and formation of such undesirable protuberances may spoil the aesthetic appearance and the decorative value to a great extent.

It is known that such a design roller may cause an abrupt and noticeable joint of the run-down with the roller on the coated surface. Accordingly, removal of such a joint may require an additional laborious finish work because the presence of such a joint otherwise damages a decorative finish appearance.

It is also known that such design rollers cannot form a new pattern with substitution for the parts of the preceding pattern, when applied a plurality of times with some parts overlapped with the preceding pattern at pressures sufficient to avoid the deformation of the evenly laid-on surface, where it otherwise should have been kept flat, and/or to disallow undesirable and noticeable protuberances from the surrounding coated surface. Since the overlapping of the run-downs with the design roller with the preceding one is usually required, particularly where a wide area is patterned, then the inability of substitution of said conventional design rollers is very disadvantageous in forming a decorative finish pattern in relief. Obviously, the lack of such an ability does leave the overlapped portions of the preceding pattern as they were intact or in part. In this case, the undesirable overlapped design segments which left unremoved should be eliminated by additional laborious work. Otherwise, in order to avoid said such problem, careful attention should be paid in applying such design rollers without overlapping of the run-downs with each other and impairing the harmony of an additional pattern with the preceding patterns formed adjacent and next thereto. With lack of substitution ability, conventional design rollers have been applied to an evenly laid-on surface; otherwise, the finished decorative relief is formed on a rough surface. This is extremely disadvantageous for a decorative relief finish article or substrate with decorative value.

In conventional methods, it is very difficult to form a pattern with its top portions of projection rendered flat, so that such portions usually are press-levelled to be flat thereafter. The press-levelling, however, may tend to make a slight portion of the projections bent down over the patterns incised beneath the surrounding surfaces. Accordingly, such portions, when stained by dust or dirt foreign material, are very difficult to clean up by spraying or splashing a liquid such as water against the stained surfaces. This tendency is also disadvantageous from a practical point of view.

It is further known to the art that there has been a design roller which has been employed for this purpose, the design roller having a design which has a direction and which is composed of design units in a symmetrical and regular arrangement or configuration on the whole area thereof. This type of design roller has the disadvantage that it is very difficult to form an over-all design without any abrupt or noticeable joint between the first rundown and the subsequent one with the roller, while keeping a combination of the first formed design and the subseqeunt ones.

A roller composed of an elastic, porous material comprising a polyvinyl formal is also known from Japanese Utility Model Publication No. 14,666/1973. However, this roller is designed as a coating applicator, so that its pores present therein should be large enough to retain a sufficient amount of a coating composition therein. If such a applicator roller is used for the purpose of this invention, it would be obviously apparent that a coating composition present on an article or substrate in entrapped in the interstices of its porous material. From this reason, such a porous material cannot be used for the present purpose.

It is therefore the primary object of the present invention to provide a method of forming a decorative relief pattern on the surface of an article or substrate by which the disadvantages of the conventional methods can be improved.

Another object of the present invention is to provide a pattern-forming device which is particularly adapted to forming a decorative relief finish pattern with efficiency and with ease.

Figure 6A:
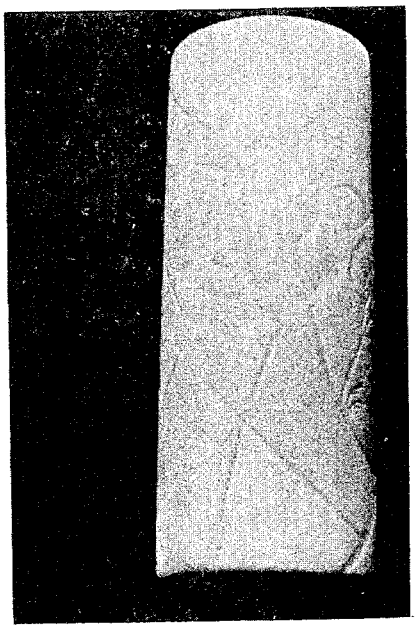
Figure 7A:
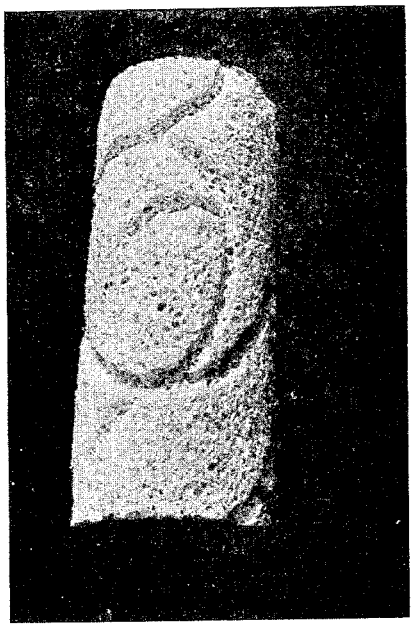
Figure 6B:
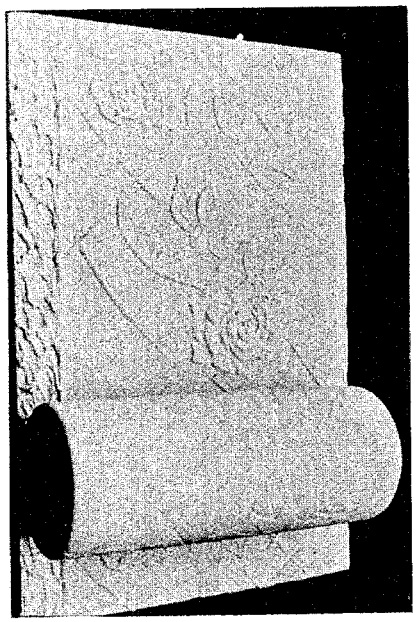
Figure 7B:
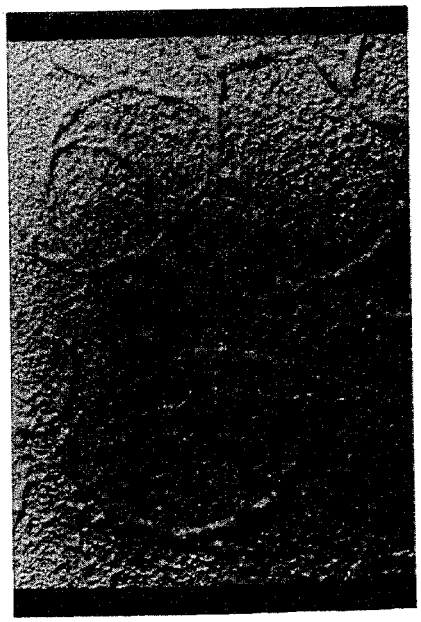
Figure 8A:
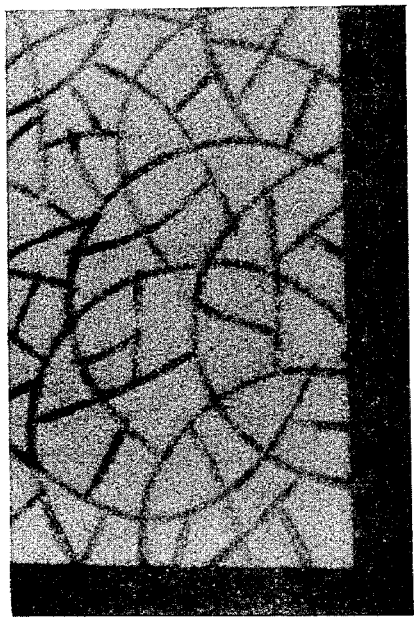
Figure 8B:
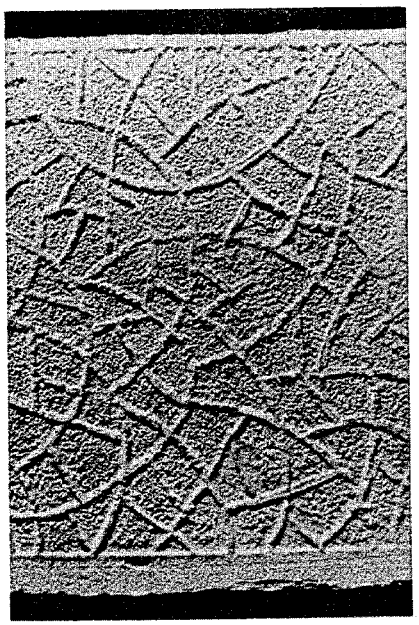

Other objects, features and advantages of the present invention will become more apparent in the following description and from the accompanying drawings, in which:

FIG. 1*a* to 5*a* are each a perspective view of a pattern-forming roller carrying out the method of the present invention;

FIGS. 1*b* to 5*b* are each a plan view of the surface of an article showing the pattern formed by the pattern-forming device of FIGS. 1*a* to 5*a*, respectively;

FIGS. 6*a* and 8*a* are each a photographic picture, on a reduced scale, showing the pattern-forming device according to the present invention;

FIGS. 6*b* and 7*b* are each a photographic picture, on a reduced scale, showing the pattern formed by the devices of FIGS. 6*a* and 7*a*, respectively; and FIG. 8*b* is a photographic picture, on a reduced scale, showing the pattern and the pattern-forming device according to the present invention.

One aspect of the present invention is a method of forming a decorative relief finish pattern on the surface of a coated article or substrate with a pattern-forming device. Another aspect of the present invention resides in the employment of a pattern-forming device for the method of forming a decorative relief finish pattern on the surface of a coated article or substrate.

The pattern-forming device according to the present invention is composed of a material that is rigid or semi-rigid, porous and air-permeable. Such a material is any filtering material which has been generally used for filtering air or liquid in the chemical and fermentation industries. It should be noted herein, however, that the material to be employed for the device of the present invention may be defined by its property to absorb water or a liquid therein. This property may be expressed in percentage as a percent water (or liquid) absorption which may be in turn determined by the following equation:

$$\text{Percent Water (or Liquid) Absorption} = \frac{W_1 - W_0}{V} \times 100$$

where $W_1$ is a weight of the material after the 2-hour immersion in water or liquid; $W_0$ is a dry weight of the material before the immersion; and V is the weight of the water or liquid corresponding to the volume of the material after the immersion. Thus the percent water (or liquid) absorption is determined in terms of the amount of the water or liquid contained in the material per unit volume of the wet material. In this case, the kind of a liquid in which the material is immersed may be chosen depending upon the kind of a liquid to be employed in a coating composition. Thus, where an inorganic coating composition such as a cementing material is used, water may be chosen. Where an organic coating composition such as a resin putty is used, the liquid or equivalent of the liquid to be employed therefor may be preferably chosen. The percent water (or liquid) absorption of the material to be used in the present invention may range from about 15 to about 99 percent and preferably from about 40 to about 95 percent.

By the term "rigid" used herein is meant a property that the material to be used for the pattern-forming device of the invention can be strong enough to form a pattern on the surface of an article or substrate coated thereon with conventional coating composition, for example having a dilatant property, although not limited thereto, without deformation or damage in the shape of the design provided on the surface of the pattern-forming device. By the term "semi-rigid" used herein is meant a property that the material for the device is less rigid than the previously defined "rigid", but that it is strong enough to form a pattern on the surface with a coating having a thixotropic coating composition without any undesirable deformation in the shape of the design on the device surface as it is applied to the coated surface. A material to be used for the device may be chosen depending largely upon the kind of a coating composition on which the pattern corresponding to the design of the device is formed. The coating composition may possess a viscosity of from about 20 to 1,000 poises, preferably from about 150 to about 300 poses, and more preferably from about 200 to 250 poises. Furthermore, where the coating composition having a thixotropic property is employed, on the one hand, the material for the pattern-forming device is a material which has a rigidity sufficient to form a pattern on such a coating layer upon slight pressure. Where the coating composition used has a dilatant property, such as mortar, on the other hand, the material for the device should have a relatively great rigidity sufficient to resist a fairly high pressure and form a pattern on the article or substrate surface.

Examples of such materials are conventional rigid or semi-rigic (including elastic), hydrophilic or lipidophilic, plastics such as, for example, polyvinyl formal, polyethylene, ethylene-vinyl, acetate copolymer, polyvinyl chloride, polyurethane, polystyrene, ethylene-butadiene copolymer, rubbery material, non-woven cloth, fibrous filter material, unglazed pottery material, glass foam or laminated paper material immersed in a phenolic resin ("microbon," manufactured by Fuji Filter Industry, Co.) or those surface-treated with a liquid, coating or resin comprising a urea resin, melamine resin, phenolic resin, silicone resin or neoprene rubber. Polyvinyl acetal and that surface-treated with said resin treatment, which has a percent water (or liquid) absorption of from about 40 to 95 percent, is preferred. These materials possess semi-continuous or continuous pores therein, thereby permitting air to permeate therethrough and, when the pattern-forming device is applied while being wet with a releasing agent such as water, an organic solvent, silicone oil or other repellent materials, allowing to entrap such a releasing agent in the interstices of the pores therein.

Where a coating composition having a very low viscosity is employed, the use of such a releasing agent sometimes may not be required. In almost all cases, however, such a releasing agent is preferably employed. In this case, the employment of such a porous material can present a particularly advantageous feature. The releasing agent which is contained in the interstices of the material for the pattern-forming device, when pressed on the surface of a coated article or substrate, is forced to ooze out and it can serve as an intermediate layer between the surface of the device and the coated surface. The intermediate presence of such a layer can allow the device surface to leave the surface of the patterned surface as it is transferred from one plate to another without accompanying any amount of a coating thereon. This is an extremely advantageous feature produced by the present invention, and this feature has not been achieved by conventional pattern-forming devices. Another advantage of the use of the pattern-forming device having such a quality is that the releasing agent, once given out from the surface of the device when pressed on the coated surface for the pattern-forming, may be again absorbed therein when the device leaves. This function can help the patterned surface to dry out faster than those prepared by conventional methods in which non-porous materials that cannot retain the releasing agent therein are used.

The pattern-forming device according to the present invention may be of any shape including a cylindrical, plane or curved shape. A design on the surface of the pattern-forming device may be formed in conventional manner. For example, a design may be carved in the surface thereon by cutting off the corresponding portions. The design to be formed on the surface of the device may not be limited whatsoever to those illustrated in the drawings. Even a directional design may be possible, but such a design is not particularly preferred for embodying the present invention in terms of the difficulty in arranging the design units in a harmony with each other. Although in a case where such a directional design is arranged at either or both end portions of the surface of the device, the formation of a pattern without a noticeable joint between the first run-down and the subsequent one requires the laborious attention of applicators and, in this respect, such a case is not preferred. In other cases where such a directional design is disposed in the intermediate portion or in part of the pattern-forming device, no objectionable difficulty can be recognized and this feature can be included within the scope of the present invention in the same manner as in a case where no directional design is arranged thereon. That is, there is no limitation on a design to be formed on the surface of the device according to the present invention. It is particularly to be noted that the device of the present invention is preferably applicable to a pattern with complex construction, as illustrated in the accompanying drawings, although the pattern to be formed by the method of the present invention should not be construed as being limited to those seen therein. The height or depth of the design may usually be up to about 10 mm., although it may vary depending upon the kind of the coating composition and/or the hardness of the coating layer.

In order to effectively carry out the method of the present invention, it is preferred that the area surrounding the design on the surface of the pattern-forming device is flat. With the flat surrounding surfaces, the device of the present invention can fully achieve its function to replace the previously formed pattern by an additional pattern when applied a plurality of times with their pattern portions overlapped. Thus, the pattern-forming device can substitute an additional pattern for the preceding ones and at the same time make the surrounding areas flat, under pressure sufficient to form such an additional pattern without an undesirable and noticeable joint between the patterns formed by the first runs with the device and the subsequent one and furthermore without causing undesirable and noticeable protuberances from the surrounding surface along the runs. With this substitution ability, since the device of the present invention can flatten or press-level the unevenly laid-on surface of an article or substrate, it is not necessary that the surface is laid on evenly prior to the pattern-forming. This is a great advantage because in conventional methods, the surface should be laid on as evenly as possible prior to the pattern-forming; otherwise, the surface areas surrounding the patterns are left unflattened and uneven. Since the device of the present invention can finish a patterned surface merely by applying it to the surface of an article or substrate, no further processing for finishing the patterned surface is required. This is the characteristic feature that has become feasible for the first time by the method of the present invention.

In the practice of the method of the present invention, the pattern-forming device is applied to the surface of an article or substrate coated with a coating composition. The time of application of the device may vary from a time immediately after the coating composition is applied to a time before the coating composition so coated is not hardened to such an extent that the formation of a pattern on the surface thereof is rendered difficult. Accordingly, the time when the device is applied may be preferably selected depending upon the kind of the coating composition employed. The device may be operated manually or mechanically. In the application to the surface of a coated article or substrate, it is preferred that the device is applied to the coated article or substrate surface while it is wet with a releasing agent, whereby the design portions of the device may be easily released from the patterned surface on the coated article or substrate. The releasing agent may be any liquid material which does not dissolve, swell or transform the porous material of the device to such an extent to plug its interstices. Examples of such releasing agents are water; silicone; an organic solvent such as an aliphatic or aromatic hydrocarbon, e.g., naphtha, toluene or xylene, an ester, e.g., ethyl acetate or butyl acetate, a ketone e.g., methylethylketone or methylisobutylketone, an alcohol, e.g., ethanol, butanol, ethylene glycol, propylene glycol or glycerine or an ester thereof, an ether or an anone; or other repellent materials, e.g., oils, fats or paraffins. As a rule, the kind of a releasing agent to be held in the material of the pattern-forming device is preferably the same as that contained in the coating composition to be used for the coated article or substrate. For example, where the coating composition contains an aqueous resin emulsion, the employment of water is preferred. Where the coating composition contains an organic solvent, it is preferred to employ the same organic solvent or equivalent thereof.

The coating composition to be coated on an article or substrate according to the present invention may include any coating material, inorganic or organic, capable of forming a thick film on the surface thereof. It comprises an organic material or an inorganic material and, when desired, an aqueous synthetic emulsion. The organic coating material may be any conventional material of the putty, mastic or lysinic type comprising a highly viscous aqueous emulsion coating material, a water-soluble coating material, an extremely involatile epoxy resin coating material, an organosol or plastisol, a synthetic resin putty, an oil putty or a cashew nut putty. Said synthetic resin putty may be an unsaturated polyester resin putty or a vinyl resin putty. The inorganic coating material is a cementing material, mortar, plaster or stucco. Said cementing material is a mixture of cement with a conventional filler such as sand. Said inorganic coating material is commercially available. The aqueous synthetic resin emulsion may include a vinyl acetate resin emulsion, a vinyl acetate copolymer emulsion, an acrylic resin emulsion, a synthetic rubber emulsion, a petroleum resin emulsion or an epoxy resin emulsion. Said vinyl acetate copolymer emulsion may include a vinyl acetate-vinyl ester copolymer emulsion: e.g., a vinyl acetate-VeoVa (trade mark) copolymer emulsion—VeoVa is the vinyl ester of a synthetic saturated, mainly tertiary carboxylic acid having up to 12 carbon atoms. Of these coating compositions, those having a viscosity of from about 20 to 1,000 poises, preferably from about 150 to 300 poises, and more preferably from about 200 to 250 poises, are preferred. The coating composition which possesses a thixotropic property is preferred. It also may be of the type having such properties that it dries out at ambient temperature and/or it becomes cured upon the application of heat. In order to provide the coating composition with thixotropic properties, a further addition of known additives such as a pigment having a great liquid absorbency or a resin which is subject to swelling in the presence of water may also be taken into consideration. Other conventional additives such as, for example, extender pigments, materials for increasing viscosity, stabilizers, defoamers and the like may be added to the coating composition.

The article or substrate on which the coating composition is coated in conventional manner may be any conventional base material including, for example, a sheet or plate of concrete, mortar, plaster or stucco, slate plate, calcium silicate plate, magnesium carbonate plate, plasterboard, precast concrete plate, or wooden polywood material comprising veneer plywood, hardboard or composition board, sound absorbent, particle board or a plate or sheet composed of iron, stainless steel or aluminum. The article or substrate with a pattern thereon is particularly useful as a building material and it is used for interior and exterior finish. It may be used for decoratively finishing walls, columns or floors or any outdoor places. The method according to the present invention may also be applicable to a special technical field, such as in the manufacture of patterned tiles or ceramics or pottery or in the preparation of an advertising means such as poster columns or advertising pillars.

The patterned article or substrate is then dried in conventional manner, i.e., by leaving it to stand in place. It then is usually subjected to finish work for a decorative relief pattern. This finish work may be carried out during the course of the drying of the patterned article or substrate, but it is preferred to do finish work after becoming substantially dry from the standpoint of handling with ease. If desired, some portions of pattern may be further processed in conventional manner, for example, by sanding with a sander. However, such a processing procedure is usually not required in the practice of the present invention. The finish work is preferably carried out by coating the partterned article or substrate surface with a topcoat in conventional manner, i.e., by spraying a topcoat against the surface thereof with a conventional coating device such as a spray gun. The topcoats to be used for this purpose may be any one of various paints of the type which can generally be employed as topcoats in this art and which can be dried at ambient or elevated temperatures, such as organic paints, inorganic paints, multicolour paints (suspension paints) or flame-retardant paints. Examples of these paints are alkyd resin paints, nitrocellulose lacquer, acrylic lacquer, polyurethane resin paints, epoxy resin patins, polyester resin paints, water-soluble resin paints, water-base emulsion paints, lysinic paints, melamine resin paints, acrylic resin paints, phenolic resin paints, polyvinyl chloride resin paints, fluoroplastic paints, silicone paints or inorganic paints. These paints may be of any type having a property to dry out at ambient or elevated temperatures. They may also comprise vehicles without any pigment, or contain powders of metals which are conventionally employed in this art. It may also be advantageous to tone the relief with a different colour, for example to apply a darker tone to the incised areas to bring out the pattern in relief in a more decorative manner. For this purpose, a paint to be employed may be such that its vehicle is different from that of the topcoat which is used to give a different tone to the incised areas or its hue, brightness or shade may be different from that of the other topcoat and it may be chosen among those illustrated hereinabove as topcoats depending upon what effects are to be achieved. The topcoat may be of any type having a glaze, although a topcoat having no glaze may also be employed.

The following examples serve as illustrations of the present invention, but they should not be construed at all as limiting the same thereto.

EXAMPLE 1

(1) Pattern-forming Roller

A roller was manufactured with an air-permeable, porous, rigid synthetic resin containing as a major component polyvinyl acetal ("Kanefil #2510," trade mark of Kanebo Gosei Kagaku Kabushiki Kaisha; a percent water absorption of 93.3 percent). The roll is of a hollow cylinder as shown in FIG. 1*a*, having a length of 175 mm., an outer diameter of 70 mm. and an inner diameter of 42 mm. The surface of the roll was provided with a design, as illustrated in FIG. 1*a*, incised beneath the surrounding surface. Each of the design units composed of annular rings is from 50 to 60 mm. long and from 1 to 2 mm. deep. And the linear holes constituting the design are from 2 to 3 mm. wide.

(2) Coating Composition

A commercially available coating composition having a viscosity of 22,000 centiposes at 18° C. was employed. It has the following composition (in percent by weight):

| | |
|---|---|
| Vinyl acetate-VeoVa (trade mark) resin emulsion | 16.0 |
| Calcium carbonate pigment | 10.0 |
| Silica filler | 50.0 |
| Hydroxylethyl cellulose | 0.5 |
| Titanium dioxide | 10.0 |
| 25% Ammonia | 0.2 |
| Silicone defoamer | 0.3 |
| Water | 13.0 |

(3) Coating

A 450×900×6 mm. flexible board was coated with 600 grams of said coating comosition at 20° C. with a conventional polyurethane sponge roll applicator. The coated substrate was left to stand for about 10 minutes for further processing.

(4) Pattern-Forming

Figure 1B:
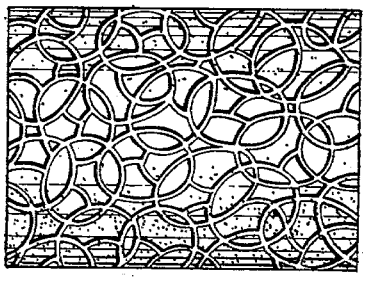

After being dipped in water, said pattern-forming roller was applied to the surface of said coated flexible board a plurality of times to form a pattern thereon as illustrated in FIG. 1*b*.

(5) Topcoating

A polyurethane enamel was twice sprayed against the surface of said patterned article after the drying at room temperature for 15 hours.

Th pattern formed in relief thereon a uniform appearance without any noticeable joint between the first run-down with the roller and the subsequent ones. This article is particularly applicable to interior finish work.

EXAMPLE 2

(1) Pattern-forming Roller

Figure 2A:
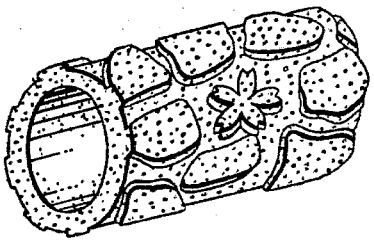
Figure 3A:
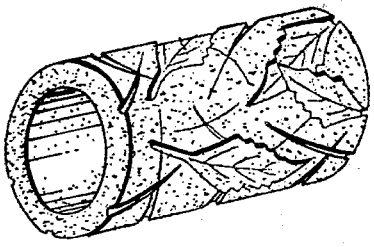
Figure 4A:
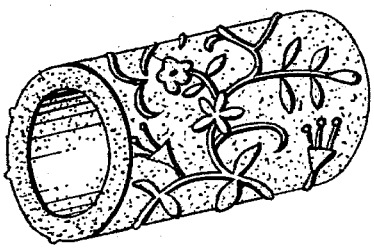

A roller having the same size as that disclosed in Example 1(1) was manufactured using a porous, air-permeable and rigid resin prepared from polyvinyl acetal ("Kanefil #2810", trade mark of Kanebo Gosei Kagaku K.K.; a percent water absorption of 65.7 percent). A design in relief was formed on the surface of the cylindrical roll as illustrated in FIG. 2*a*, in which each of the design units is from about 60 to 70 mm. long and from about 3 mm. high with a distance of from about 9 to 10 mm. between the design units.

(2) Coating Composition

A commercially available aqueous epoxy-type coating composition having a viscosity of 30,000 centipoises at 20° C. prepared by admixing a coating base with a hardening agent in the weight ratio of the former to the latter of 10:0.8 was employed. The coating base and the hardening agent have the following compositions (in percent by weight):

| | | |
|---|---|---|
| (a) | Coating Base | |
| | Water-dispersible epoxy resin | 25.0 |
| | Rutile titanium dioxide | 2.0 |
| | Calcium silicate pigment | 6.5 |
| | Aluminum silicate pigment | 6.5 |
| | Silica filler | 35.0 |
| | Hydroxylethyl cellulose | 10.0 |
| | Silicone defoamer | 0.3 |
| | Dibutyl phthalate | 5.0 |
| | Water | 10.0 |
| (b) | Hardening Agent | |
| | Water-soluble modified polyamide resin | 100.0 |

(3) Coating 1.5 kilograms of said coating composition was coated on a 450×900×6 mm. flexible board with a conventional porous roll applicator. The coated board was left to stand for 3 minutes for pattern-forming.

(4) Pattern-Forming

Figure 2B:
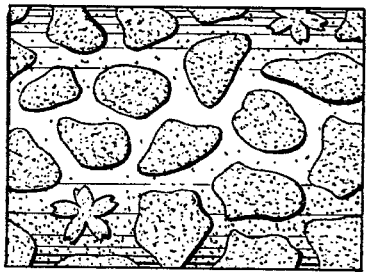
Figure 3B:
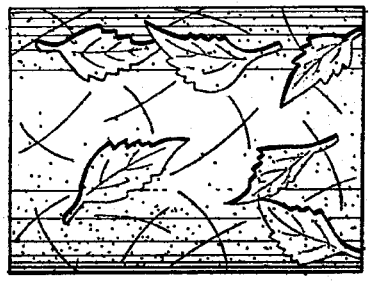
Figure 4B:
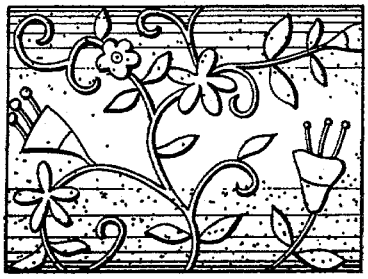
Figure 5B:
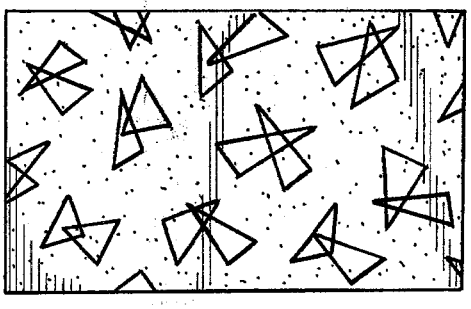

Said pattern-forming roller was applied in the same manner as in Example 1(4). A pattern as illustrated in FIG. 2*b* was formed without noticeable joints between the rundowns with the roller.

(5) After-treatment and Topcoating

Said patterned article was left to stand for 2 hours and then subjected to a further processing while the coating is not yet completely dry. Thus, the areas in relief were flattened and levelled with a roller having the flat surface. The roller was prepared with the same material so as to have the same roll size as that of Example 2(1).

After being dried for 15 hours, the coated article so treated was then coated twice with a topcoat comprising a polyurethane resin metallic enamel.

The patterned article has a good contrast between the smooth surface in relief and the surface depressions having the somewhat rough finish surfaces. This article is particularly suitable as facing building material.

EXAMPLE 3

(1) Pattern-forming Roller

A hollow roll having a length of 190 mm., an outer diameter of B 44.5 mm. and an inner diameter of 35 mm. was manufactured with laminated cellulose ribbon immersed in a phenolic resin ("Microbon 6R-28", manufactured by Fuji Filter Industry Co.). A design as shown in FIG. 1*a* was carved in the roll surface. Each of the design units consisting of annular rings is from 50 to 60 mm. long and from 1 to 2 mm. deep. The line-shaped holes or conduits are from about 2 to 3 mm. wide.

(2) Coating Composition

The vinyl acetate-Veoba (trade mark) resin emulsion coating composition employed in Example 1(2) was employed.

(3) Coating

The coating was carried out on the same substrate in the same manner as in Example 1(3).

(4) Pattern-Forming

The pattern was formed on the substrate surface in the same manner as in Example 1(4) 15 minutes after the coating.

(5) Topcoating

The dried, patterned substrate was coated with the same topcoat as in Example 1(5). This topcoated article showed the same appearance as that obtained by Example 1.

EXAMPLE 4

(1) Pattern-forming Roller

The same roller as in Example 2(1) was employed. The percent liquid absorption was determined using petroleum naphtha. The determined value was 67.1 percent.

(2) Coating Composition

A commercially available polyester putty containing a putty and a hardner (cyclohexanone) in the weight ratio of the former to the latter of 50:1 was used. The polyester putty had a viscosity of 1,200 centipoises at 20° C. The putty has the following composition (in percent by weight):

| | |
|---|---|
| Polyester resin vanish | 32.0 |
| Rutile titanium dioxide | 5.0 |
| Calciumcarbonate pigment | 29.0 |
| Magnesium carbonate pigment | 29.0 |
| 1.5% Cobalt naphthenate | 2.0 |
| Zinc stearate | 3.0 |

(3) Coating 1.5 kilograms of said polyester putty was laid on evenly with a trowel to the surface of a 450×900×6 mm. flexible board.

(4) Pattern-Forming

After it was left to stand for 5 minutes, the coated board was patterned with said pattern-forming roller which had been previously dipped in petroleum naphtha.

(5) After-treatment and Topcoating

After it was left to stand for 18 hours to harden the coating completely, the patterned substrate was subjected to sanding. The surfaces of the projections were sanded, thereby making them flat and smooth.

The substrate so treated was then coated in the same manner as in Example 2(5).

The topcoated article exhibited the same appearance as that obtained by Example 2.

EXAMPLE 5

(1) Pattern-forming Roller

The roller employed in Example 3 was used.

(2) Coating Composition

A commercially available polyurethane putty having a viscosity of 180 centipoises at 20° C. was employed. The polyurethane putty was a mixture of a polyurethane resin putty and a hardner in the weight ratio of the former to the latter of 10:1. The resin putty and the hardner have the following composition (in percent by weight):

| | | |
|---|---|---|
| (a) | Polyurethane resin putty base | |
| | Hydroxyl-containing polyester | 20.0 |
| | Anatase titanium dioxide | 7.0 |
| | Magnesium silicate pigment | 40.0 |
| | Magnesium carbonate pigment | 20.0 |
| | Hydrocarbon solvent | 13.0 |
| (b) | Hardner | |
| | Polyisocyanate | 55.0 |
| | Hydrocarbon solvent | 45.0 |

(3) Coating 600 grams of said polyurethane putty was laid on evenly with a spatula to the surface of a 450×900×6 mm. flexible board.

(4) Pattern-Forming

Immediately after the coating was laid on, the coated substrate was patterned with said roller using the thinner.

(5) Topcoating

After it was left to stand for 15 hours at room temperature, the patterned substrate was coated in the same manner as in Example 1(5).

The topcoated article showed the same appearance as that obtained in Example 1.

EXAMPLE 6

(1) Pattern-Forming Roller

The roller used in Example 1, but having a design as illustrated in FIG. *6a* was employed.

(2) Coating Composition

The same coating composition as employed in Example 1 was used.

(3) Coating

The procedure employed in Example 1(3) was repeated using the materials employed therein.

(4) Pattern-Forming

The pattern was formed in the same manner as in Example 1(4).

(5) Topcoating

The topcoating used in Example 1(5) was repeated using the same procedure and materials as therein.

The topcoated article exhibited the same appearance as that obtained in Example 1. FIG. *6b* shows that the area where the device was run on the unevenly laid-on surface of the said substrate has a flat surrounding surface around the design in relief. It is to be noted that there is an appreciable difference from the uneven area where it was left unrolled as a comparison.

EXAMPLE 7

(1) Pattern-forming Roller

A roll having the same size was manufactured in the same manner as in Example 1(1). The roll was then provided with a design as shown in FIG. *3a*, the design was incised beneath the surrounding surfaces. Each of the design units are from about 60 to 70 mm. long and from about 1 to 2 mm. deep.

(2) Coating Composition

The coating composition used in Example 1 was used.

(3) Coating

A 450×900×6 mm. veneer plywood was coated with 800 grams of said coating composition with a conventional sponge roll applicator at room temperature.

(4) Pattern-Forming

With said roller immersed in water, the coated substrate was pressed so as to form the pattern and at the same time flatten the areas surrounding the patterns. The patterns were formed without undesirable and noticeable joints between the run-downs with the roller.

(5) Topcoating

After it was left to stand for 15 hours at room temperature, the patterned substrate was coated twice with a resin emulsion coating composition ("V #5000 Cream-Colour" manufactured by Nippon Paint Co., Ltd.) by a coating roller. After being allowed to stand for 2 hours, it was again coated with a coating composition ("V #5000 Faint Green Colour" manufacture by Nippon Paint Co., Ltd.) with a coating roller to colour the flat areas surrounding the patterns. This is particularly applicable to interior finish work.

EXAMPLE 8

(1) Pattern-forming Roller

A roll having the same size was manufactured in the same manner as in Example 1(1), using a rigid, porous, air-permeable synthetic resin with polyvinyl acetal as the major component ("Kanefil #2310" manufactured by Kanebo Gosei Kagaku K.K.; a percent water absorption of 37.5 percent). The roll was provided with a design in relief, as illustrated in FIG. *4a*. The designs were from about 1 to 2 mm. high.

(2) Coating Compoaition

The aqueous epoxy coating composition employed in Example 2 was used.

(3) Coating

A 900×400×2 mm. steel plate was coated with 700 grams of said coating composition with a trowel at room temperature.

(4) Pattern-Forming

After being coated, said roller was immediately applied to the coated substrate. This gave a clear pattern with the flat surrounding surfaces.

(5) Topcoating

The patterned surface was then sprayed twice with a polyurethane resin enamel after being dried for 15 hours at room temperature. Three hours later, the top portions of the surface were further coloured with a coating composition having a different colour.

The topcoated article having two different colours is particularly useful as exterior finish work.

EXAMPLE 9

(1) Pattern-forming Roller

The roller used in Example 2 was employed.

(2) Coalting Composition

Mortar having the following composition (in percent by weight) was employed.

| | |
|---|---|
| White cement | 25.0 |
| Silica | 50.0 |
| Water | 25.0 |

(3) Coating

A 300×600×6 mm. flexible board was laid on evenly with 2.0 kilograms of said mortar with a trowel.

(4) Pattern-Forming

Said roller was first dipped in water and applied to the surface of said coated substrate. There were no udesirable and noticeable joints between the patterns formed by the run-downs with the roller.

(5) After-treatment and Topcoating

The patterned surface was treated in the same manner as in Example 2(5). The substrate so treated was then coated three times with a vinyl chloride resin enamel three days later.

The article so topcoated is particularly applicable to exterior finish work as facing building material.

EXAMPLE 10

(1) Pattern-forming Roller

The roller used in Example 1 was employed.

(2) Coating Composition

A plaster composition having the following composition (in percent by weight) was applied.

| | |
|---|---|
| Plaster | 65.0 |
| Acrylic resin emulsion | 5.0 |
| Water | 30.0 |

(3) Coating 1.5 kilograms of said plaster composition was laid on evenly with a spatula to the surface of a 300×600×6 mm. flexible board.

(4) Pattern-Forming

Said roller was first wet with water and then applied to the laid-on surface to form a pattern thereon. The pattern was formed without any abrupt and noticeable joints between the first run-down and the subsequent one with the roller.

(5) Topcoating

The patterned surface was dried for 15 hours while being sprayed with water from time to time in order to avoid the rapid drying. The surface was then coated twice with a resin emulsion.

The article so treated gave the same appearance as that obtained in Example 1.

EXAMPLE 11

The procedures employed in Example 10 were repeated using the roller and materials used therein except that a plaster comprising 67 percent by weight of plaster and 33 percent by weight of water was used instead of the plaster composition.

The article so treated showed the same results as that obtained in Example 10.

EXAMPLE 12

(1) Pattern-forming Roller

A roller was manufactured with a semi-rigid, air-permeable synthetic resin having relatively large pores therein and containing as a major component polyvinyl acetal ("Han-Koshitsu Goku-Arame," manufactured by Kanebo Kabushiki Kaisha; a percent water absorption of 75 percent). The roll is of a hollow cylinder as shown in FIG. 7*a*, having a length of 175 mm., an outer diameter of 73 mm. and an inner diameter of 42 mm. Its surface was provided with a pattern as shown in FIG. 7*a*, and each of the design units composed of annular rings is from about 60 to 70 mm. long and their line-shaped holes are from about 2 to 3 mm. deep and from about 4 to 5 mm. wide.

(2) Coating Composition

The coating composition used in Example 1 was employed.

(3) Coating

A 580×800×12 mm. magnesium carbonate plate was laid on with 420 grams of said coating composition with a conventional porous roll applicator at room temperature.

(4) Pattern-Forming

After being dried for 5 minutes, the coated substrate was patterned with said roller. No abrupt and noticeable joints between the run-downs with the roller was recognized on the patterned surface.

(5) Topcoating

The patterned surface was coated twice with a polyurethane resin enamel 16 hours after the pattern was formed.

The article as shown in FIG. 7*b* is particularly suitable for interior and exterior finish work. Although the surface surrounding the designs has projections, the article so topcoated is said to be of commercial value because there is neither undesirable and noticeable joints between the runs with the device nor undesirable and noticeable protuberances along the runs.

EXAMPLE 13

(1) Pattern-forming Sheet

Figure 5A:
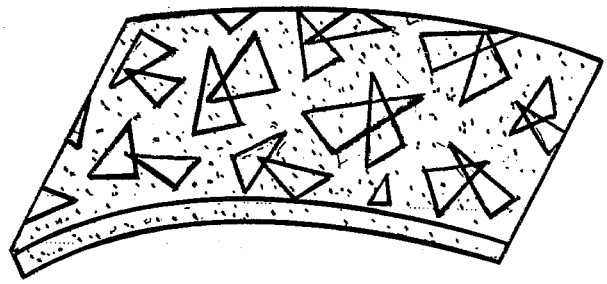

A curved plane sheet, 400 mm. long, 300 mm. wide, and 20 mm. thick, was prepared with a semi-rigid, air-permeable, porous polyurethane foam from a polyol and a polyisocyanate (manufactured by Daiichi Kogyo K. K.; a percent water absorption of 18 per cent). Its surface was provided with a design, as illustrated in FIG. 5*a*, incised beneath the surrounding surface. Each of the design units is from about 60 to 70 mm. long and from about 2 to 3 mm. deep, and the linear holes are from about 3 to 4 mm. wide.

(2) Coating composition

The coating composition used in Example 1 was employed.

(3) Coating

A 420×300×12 mm. magnesium carbonate sheet was laid on with 190 grams of said coating composition with a conventional porous roll applicator at room temperature.

(4) Pattern-Forming

After being dried for 3 minutes, the coated substrate was subjected to application of said patternforming sheet. The sheet was placed on said coated magnesium carbonate plate with the design facing the coated surface, and pressure was applied from the outer surface with a pressure roller.

The patterned surface did not show any noticeable joints between the first patterned zone and the subsequent ones.

(5) Topcoating

The topcoating was carried out in the same manner as in Example 12.

The article so topcoated is particularly applicable as a building material for interior finish work.

EXAMPLE 14

The procedures of Example 13 were repeated using the device and materials used therein except that the device is provided with a design as illustrated in FIG. 8*a*.

FIG. 8*b* shows the patterned article with projections on the surrounding surfaces, but it is suitable for finish work without sanding or such further processing procedures. It is noted that no noticeable joints join between the run-downs with the device and no noticeable protuberances along the run of the device are shown thereon.

What we claim is:

1. In the method of forming a relief pattern on the surface of an article or substrate which comprises coating the surface thereof with a coating composition and applying thereto, during the course of the drying of the coating, a pattern-forming device with a design to be patterned thereon once or a plurality of times, the improvement according to which the pattern-forming device is composed of a rigid or semi-rigid material having air-permeable pores therein and having a percent water or liquid absorption of from about 15 to 99 percent and the pattern-forming device contains a releasing agent therein, the said releasing agent being the same material as the solvent employed in the coating composition, and the said coating composition having a viscosity in the range of from about 20 to 1000 poises.

2. A method according to claim 1 wherein the surface of the pattern-forming device is provided with a design having an ability to substitute a newly formed pattern for the previous patterns present thereon under pressures without forming a noticeable joint between the rundowns with the device, and said material having a ridigity sufficient to form on the coated article or substrate surface the pattern corresponding to the design provided on the surface of the pattern-forming device without damage in the shape of the design present thereon upon pressure to the coated article or substrate surface.

3. A method according to claim 1 wherein the surface of the pattern-forming device is provided with a design which is non-directional.

4. A method according to claim 1 wherein the coating composition is an organic coating material.

5. A method according to claim 4 wherein the organic coating material is of the putty, mastic or lysinic type comprising a highly viscous aqueous emulsion coating material, a water-soluble coating material, a fairly involatile epoxy resin coating material, an organosol or plastisol, a synthetic resin putty, an oil putty or a cashew nut putty.

6. A method according to claim 5 wherein the synthetic resin putty is an unsaturated polyester resin putty or a vinyl resin putty.

7. A method according to claim 1 wherein the coating composition is an inorganic coating composition.

8. A method according to claim 7 wherein the inorganic coating material is a cementing material, mortar, plaster or stucco

9. A method according to claim 1 wherein the coating composition is an aqueous resin emulsion.

10. A method according to claim 9 wherein the aqueous resin emulsion is a vinyl acetate resin emulsion, a vinyl acetate copolymer emulsion, an acrylic resin emulsion, a synthetic rubber emulsion, a petroleum resin emulsion or an epoxy resin emulsion.

11. A method according to claim 1 wherein the viscosity of the coating composition ranges from about 150 to about 300 poises.

12. A method according to claim 1 wherein the percent water or liquid absorption of the material ranges from about 40 to about 95 percent.

13. A method according to claim 1 wherein the pattern-forming device has a rigidity sufficient to form a pattern on the surface of an article or substrate coated with a coating composition having a viscosity of from about 20 to 1,000 poises.

14. A method according to claim 1 wherein the pattern-forming device is applied to the article or substrate surface coated with a coating composition having a viscosity of from about 150 to about 300 poises.

15. A method according to claim 1 wherein the material of the pattern-forming device is a rigid or semi-rigid, air-permeable, porous material comprising polyvinyl formal, polyethylene, ethylenevinyl acetate copolymer, polyvinyl chloride, polyurethane, polystyrene, ethylene-butadiene copolymer, rubbery material, non-woven cloth, fibrous filter material, unglazed pottery material, glass foam or laminated paper material immersed in a phenolic resin or said materials surface-treated with a liquid, coating or resin comprising a urea resin, melamine resin, phenolic resin, silicone resin or neoprene rubber.

16. A method according to claim 15 wherein the material is polyvinyl acetal or polyvinyl acetal surface-treated with a resin.

17. A method according to claim 1 wherein the releasing agent is water, silicone oil, an organic solvent or a repellent material.

18. A method according to claim 1 wherein the patter-forming device is operated manually or mechanically.

19. A method according to claim 1 wherein the article or substrate is a sheet or plate of concrete, mortar, plaster or stucco, slate plate, calcium silicate plate, magnesium carbonate plate, plasterboard, precast concrete plate, a wooden plywood material comprising veneer plywood, hardboard or composition board, sound absorbent, particle board or a plate or sheet composed of iron, stainless steel or aluminum.

* * * * *